US005112063A

United States Patent [19]

Puckett

[11] Patent Number: 5,112,063

[45] Date of Patent: May 12, 1992

[54] TUBULAR RESTRAINT FOR BROADHEAD WITH DEPLOYABLE CUTTING BLADES

[75] Inventor: Riley Puckett, Lorton, Va.

[73] Assignee: Pucketts Blood Trailers Broadhead, Inc., Lorton, Va.

[21] Appl. No.: 632,332

[22] Filed: Dec. 21, 1990

[51] Int. Cl.[5] ..... F42B 6/02

[52] U.S. Cl. ..... 273/421; 273/416

[58] Field of Search ..... 273/416, 418, 419, 421, 273/422

[56] References Cited

U.S. PATENT DOCUMENTS

| | | | |
|---|---|---|---|
| 2,620,190 | 12/1952 | Bean | 273/418 X |
| 2,939,708 | 6/1960 | Scheib | 273/419 |
| 3,014,305 | 12/1961 | Yurchick | 273/419 X |
| 3,110,336 | 11/1963 | Sukala | 273/419 X |
| 3,672,677 | 6/1972 | Moore | 273/416 |
| 3,756,600 | 9/1973 | Maleski | 273/422 |
| 4,166,619 | 9/1979 | Bergmann et al. | 273/418 |
| 4,169,597 | 10/1979 | Maleski | 273/422 |
| 4,504,063 | 3/1985 | LeBus | 273/422 |

*Primary Examiner*—Edward M. Coven
*Assistant Examiner*—William E. Stoll
*Attorney, Agent, or Firm*—Whitham & Marhoefer

[57] ABSTRACT

A broadhead (10) having deployable cutting blades (22) (24) is kept in the retracted position, wherein the blades (22) (24) have a slimmer profile, during the flight of an arrow by a tubular, external restraint (20) which fits over the body (16) of the broadhead (10). When the broadhead (10) impacts against an animal, the plunger (18), which is slidably mounted in the front of the body (16) is forced into the body (16) and causes the blades (22) (24) to be deployed out of the slots (12) (14). As the blades (24) are moved out of the slot (14), the tubular restraint (20) is cut from the body (16) by the cutting edge (26).

7 Claims, 2 Drawing Sheets

FIG. 4
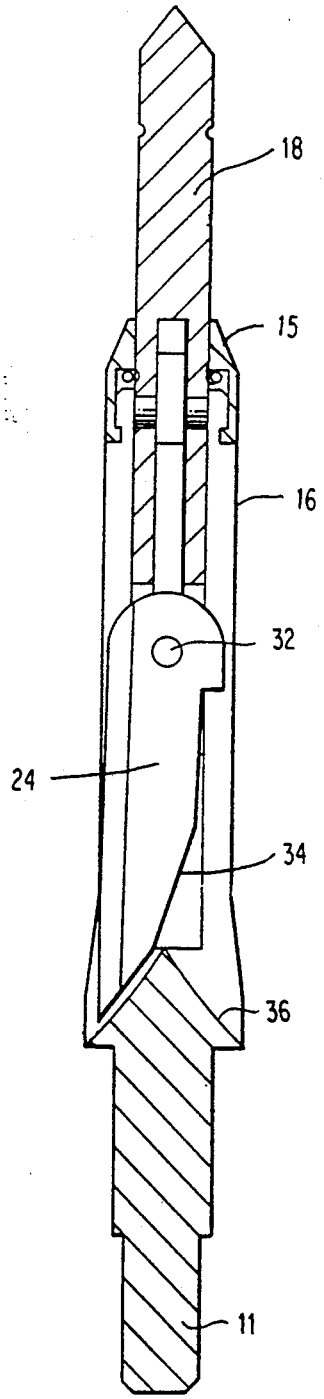
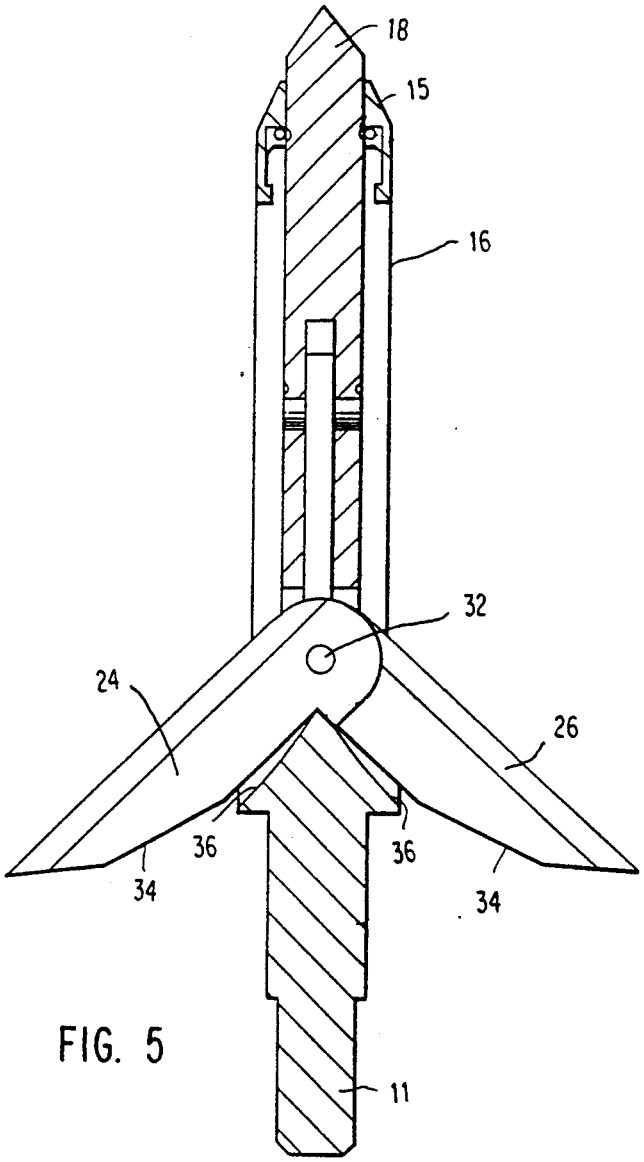
FIG. 5

TUBULAR RESTRAINT FOR BROADHEAD WITH DEPLOYABLE CUTTING BLADES

CROSS-REFERENCE TO RELATED APPLICATIONS

This patent application is related to the following co-pending patent applications, all of which are herein incorporated by reference:

Ser. No. 07/460,299, entitled "Broadhead Hunting Arrow", which was filed Jan. 3, 1990, and which issued as U.S. Pat. No. 4,998,738 on Mar. 12, 1991; and Ser. No. 07/631,646, pending, entitled "Broadhead Hunting Arrow", which is a continuation of the patent application having Ser. No. 07/460,299, which was filed Dec. 21, 1990.

DESCRIPTION

Background of the Invention

1. Field of the Invention

The present invention generally relates to a broadhead hunting arrow with deployable cutting blades wherein the blades are retracted to a slimmer, more aerodynamic profile during the flight of the arrow and wherein the blades are moved to an open position to cause greater hemorrhaging when the arrow strikes its quarry. More particularly, the invention is concerned with an improved means for holding the cutting blades in the retracted position during the flight of the arrow.

2. Description of the Prior Art

Hunting arrows with deployable cutting blades are well known in the art. The objective for any hunting arrow with deployable cutting blades is to have the blades retracted to a more aerodynamic position during the flight of the arrow and to have the blades open to a cutting position which causes maximum hemorrhaging when the arrow strikes its quary. Traditional broadheads have fixed, exposed cutting blades which are subject to wind drag and other adverse wind effects during the flight of the arrow. It has been found that broadheads designed with deployable blades overcome the problems associated with wind effects and are much more accurate than traditional broadheads.

U.S. Pat. No. 2,859,970 to Doonan discloses a cone which houses a pair of cutting blades therein where the cutting blades are mounted on a pivot pin. The Doonan device is frictionally fit over the tip of a target arrow. The intended design of the Doonan device is such that during the flight of the arrow, the cutting blades stay within the cone, thereby overcoming adverse wind effects on the flight of the arrow. When the cone strikes the animal, the arrow shaft rams the target tip into the back of the cutting blades such that they open up from the cone by pivoting on the pivot pin. One problem with the Doonan device is that the shaft of the arrow is likely to ram the cutting blades of the cone open just as the arrow is shot because of the inertia of the cone relative to the speed of the arrow. Another problem with the Doonan device is that the frictional engagement of the cutting blades against sidewalls of slots in the cone is not easily controllable.

U.S. Pat. No. 4,932,671 to Anderson shows a phantom bladed broadhead where the cutting blades remain inside a cylindrical ferrule body during flight and are rammed open by a plunger, positioned to slide rearward from the front of the body, when the plunger impacts against the body of the animal. In Anderson, the cutting blades are not connected to the plunger but are pivotally connected to the cylindrical body by a ring which passes through a forward cut out section of each blade.

U.S. Pat. No. 4,504,063 to LeBus discloses a broadhead which is designed to have a slimmer profile during flight and a wider, cutting profile upon impact. In LeBus, a plunger, which extends from the front of the broadhead while it is in flight, includes a weight at its rear section that acts against notches formed on the inside surfaces of the cutting blades when the broadhead strikes an animal. LeBus utilizes an O-ring to help hold the cutting blades in their slimmer profile during flight wherein the O-ring fits in a notched portion at the base of each cutting blade and the O-ring expands when the weight at the rear of the plunger forces the cutting blades open. Since the blades of the LeBus broadhead are always slightly open, the archer must be very careful when installing the O-ring so as not to get cut on the sharp blades of the broadhead.

The Forestline company is currently selling a broadhead called the Punchcutter TM which includes a pair of cutting blades pivotally mounted inside a body towards its rear portion. In the Punchcutter TM, a plunger extending from the front of the body rams the front tips of the blades outwards when an animal is struck by the arrow and the blades open wider by pivoting from the rear of the broadhead as the arrow is pushed through the body of the animal. The Punchcutter TM uses an O-ring to help hold the cutting blades closed during flight which fits within a notched rear section on the back sides of the cutting blades and the O-ring expands as the blades are pushed open. The body of the Punchcutter TM is fabricated with an encircling channel specifically designed for holding the O-ring.

In the applicant's co-pending application, which is cross-referenced and incorporated above, a broadhead with four cutting blades connected to a plunger is disclosed and is currently being sold as the Broadtrailer TM. In flight, the plunger of the Bloodtrailer TM extends from the front of the body and the blades are retracted within the body. Upon impact with an animal, the plunger of the Bloodtrailer TM moves into the body and the four blades are cammed outwardly. The blades are held within the body during flight by both a slip ring which is axially slidable on the plunger and which locks into channels encircling the plunger and by a biasing means that acts against each of the pairs of blades and the sidewalls of slots formed in the body.

Each of the above described arrowheads with deployable blades operate differently and utilize different arrangements for retaining the blades in a retracted position. Some arrangements do not appear like they will work properly, i.e., the frictional engagement of Doonan. Some arrangements are complex, i.e., the slip ring/plunger and bias means in the Bloodtrailer TM. Other arrangements require specially formed components, i.e., the blades with cutout portions for the ring in Anderson, the specially notched blades of LeBus, and the channelled body of the Punchcutter TM. What is needed is a simple yet effective means for holding the deployable cutting blades of a broadhead in their retracted position which is generally capable of use on most broadheads with deployable blades.

SUMMARY OF THE INVENTION

It is therefore an object of the present invention to overcome the problems of the prior art and provide a means for holding the cutting blades of a broadhead in their retracted position during the flight of the arrow which can be used on most broadheads with deployable blades.

It is another object of the present invention to provide a tubular, external restraint which encircles the body of the broadhead and holds the cutting blades in their retracted position during flight and which is cut away from the broadhead as the blades are opened upon impact of the broadhead against an animal.

According to the invention, a tubular external restraint is slipped over the body of a broadhead with deployable cutting blades when the blades are in the retracted position. The tubular external restraint is positioned above a cutting edge of the cutting blades so that when the arrow is in flight, the restraint holds the cutting blades in their retracted position. Upon impact with an animal, the cutting blades are deployed and the cutting edges of the cutting blades cut through the tubular external restraint such that the external restraint falls away and the cutting blades are positioned to inflict maximum damage to the animal.

BRIEF DESCRIPTION OF THE DRAWINGS

The foregoing and other objects, aspects and advantages will be better understood from the following detailed description of a preferred embodiment of the invention with reference to the drawings, in which:

FIG. 4 is a cross-sectional side view of a broadhead with deployable blades connected to a plunger which rides in a bore opening from the top of the broadhead body where the deployable blades are in the retracted, "in flight" position; and FIG. 5 is a cross-sectional side view of the broadhead of FIG. 4 where the blades have been moved to the deployed, "impact" position via the plunger moving rearward.

DETAILED DESCRIPTION OF A PREFERRED EMBODIMENT OF THE INVENTION

Figure 1:
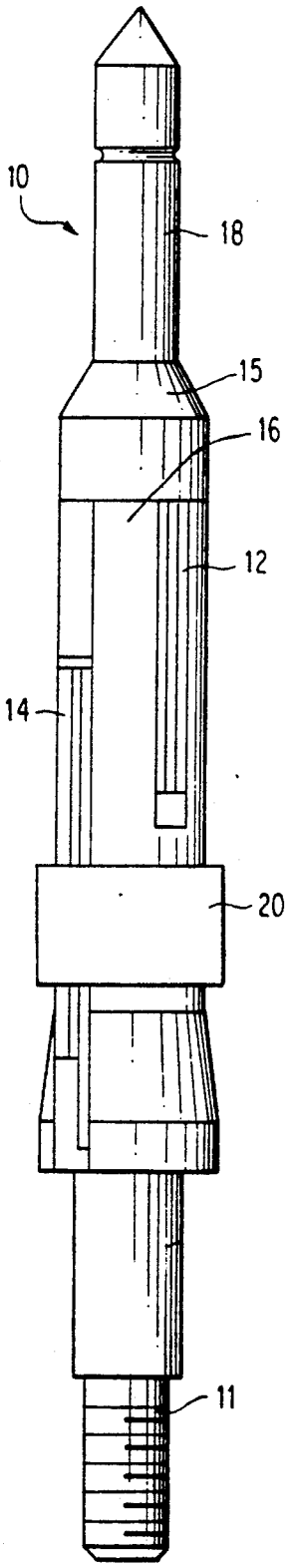
FIG. 1 is an isometric view of a broadhead with deployable cutting blades where the blades have been retracted into the broadhead body and a tubular restraint has been positioned around body of the broadhead over one of the slots into which the cutting blades have been retracted.

Referring now to the drawings, and more particularly to FIG. 1, there is shown generally a broadhead 10 with four deployable cutting blades (not shown) which are positioned within slots 12 and 14 formed in the body 16. The broadhead 10 is affixed to an arrow shaft (not shown) via threaded connection 11. FIG. 1 illustrates the "retracted" position of the broadhead where the cutting blades are the least exposed (i.e., in FIG. 1 the cutting blades are not exposed from the body 16 and in U.S. Pat. No. 4,504,063 to LeBus the cutting blades are held closer together in the retracted position). Limiting the amount of cutting blade which is exposed during the flight of the arrow reduces wind drag, wind plane, and other adverse wind effects. In the retracted position, a plunger 18 extends from the front of the body 16 of the broadhead.

The cutting blades can be connected to the plunger 18 by pivot pins as described in U.S. Pat. No. 4,998,738 to Puckett, or the cutting blades can be operable by some other mechanism such as by the plunger ramming the blades outwardly where the blades are not connected to the plunger as described in U.S. Pat. No. 4,503,063 to LeBus or U.S. Pat. No. 4,923,671 to Anderson. FIGS. 4 and 5 illustrate a preferred embodiment of the invention where the blades 24 are connected to the plunger 18 by pivot pin 32 as is described in U.S. Pat. No. 4,998,738 to Puckett. In operation, the blades 24 are held in a retracted position within the body 16 as is best shown in FIG. 4; however, upon impact with an animal, the plunger 18 is driven into the body 16 causing the back sides 34 of the blades 24 to slide on cam surface 36 and open to the deployed position as is best shown in FIG. 5. With reference back to FIG. 1, a tubular restraint 20 is slipped over the body 16 of the broadhead 10 such that it is positioned over the slot 14. The tubular restraint 20 serves to hold the cutting blades in their retracted position at inertia of release and during the flight of the arrow.

The tubular restraint 20 is the focus of this invention and is independent of the mechanism by which the cutting blades are operated by the plunger 18. For example, in FIG. 1 the tubular restraint 20 is positioned over the lower slot 14 and is not required over slot 16 since, as described in U.S. Pat. No. 4,998,738 to Puckett, the upper cutting blades are held by the cap 15 over the body 16 in the retracted position. However, if the broadhead 10 was constructed similar to those shown in U.S. Pat. No. 4,932,671 to Anderson and U.S. Pat. No. 4,504,063 to LeBus or if the broadhead 10, shown in FIG. 1, only had one pair of cutting blades, i.e., the ones retracted into slot 14, the tubular restraint 20 would be positioned above each of the cutting blades.

Figure 2:
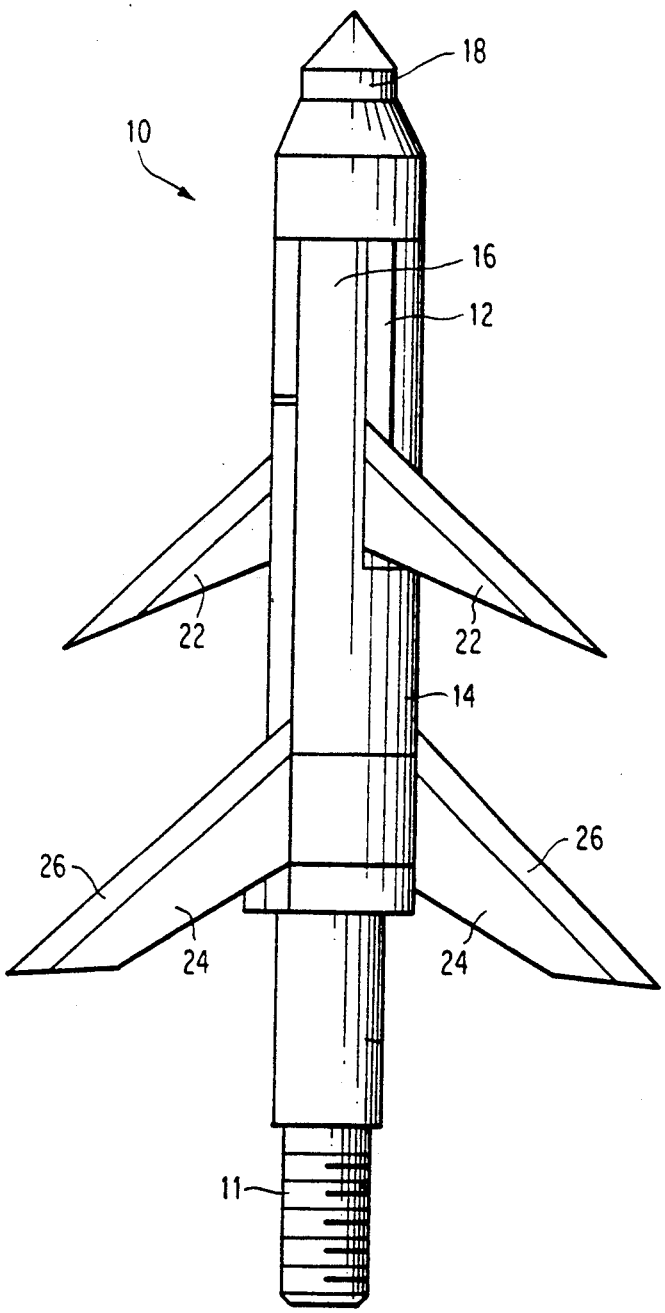
FIG. 2 is an isometric view of the broadhead of FIG. 1 where the cutting blades have been deployed and the tubular restraint has been cutaway.
Figure 3:
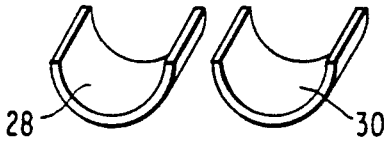
FIG. 3 is an isometric view of the two halves of the tubular restraint shown in FIG. 1 after the cutting blades have been deployed as shown in FIG. 2

FIGS. 2 and 3 show that when the plunger 18 is forced towards the body 16, which occurs when the broadhead 10 impacts on an animal, the two pairs of cutting blades 22 and 24 are opened and extend from the slots 12 and 14, respectively. When the cutting blades 22 and 24 are opened, the cutting edges 26 of the lower cutting blades 24 slice through the tubular restraint 20. The tubular restraint 20, which is preferably a piece of plastic or rubber tubing, is divided into one or two pieces 28 and 30 which fall away from the body 16 as the cutting blades 24 are deployed.

The function of the tubular restraint 20 is to keep the cutting blades 24 within the body 16 while the arrow is in flight. Therefore, the materials and dimensions of the tubular restraint 20 are selected such that the tubular restraint 20 can withstand any outward urging force which will be exerted prior to impact by the cutting blades 24. As described in the U.S. Pat. No. 4,998,738 to Puckett, the blades 22 and 24 are connected to a plunger 18 which is essentially dead weight when the arrow is shot. There will be a tendency, due to inertia, for the body 16 to ride up on the plunger 18 and thereby cam open the blades 24. Likewise, in both U.S. Pat. No. 4,932,671 to Anderson and U.S. Pat. No. 4,504,063 to LeBus, the body tends to move the blades against the back end of the plunger which is relatively stationary when the arrow is shot. In U.S. Pat. No. 4,998,738 to Puckett, a means including a slip ring (not shown) which rides on the plunger 18 was used to counter the tendency of the body 16 to ride up over the plunger 18 which would force the blades 24 outwardly. In the Anderson patent, a ring positioned within a channel of the plunger was used to counter the movement of the body relative to the plunger. It is not clear what means, if any, was used to counter the movement of the body relative to the plunger in the LeBus device. Clearly, providing an external tubular restraint which is strong enough to not be cut when the arrow is urged outwardly due to forces produced when the arrow is shot but which is weak enough to be cut when the arrow impacts against an animal provides a much simpler solution and a direct means for holding the cutting blades in their retracted position during the flight of the arrow.

If the tubular restraint 20 was too thin or was constructed of weak materials, the outward urging forces exerted on the cutting blades 26 when the arrow is shot would permit the cutting edge 24 of cutting blades 26 to slice through the tubular restraint 20 and become exposed during the flight of the arrow. In order to determine the ideal characteristics of a tubular restraint, testing has been performed on tubular restraints 20 with the broadhead which is described in U.S. Pat. No. 4,998,738 to Puckett. Excellent results were achieved with a piece of plastic tubing having the following dimensions: 0.275 inches on the inside diameter (to fit snugly around the cylindrical body of the broadhead), 0.200 inches in linear length (the top to bottom distance for the tubular restraint 20 shown in FIG. 1), and 0.020 inches in thickness. The dimensions of the tubing for the tubular restraint 20 can be varied, but should not be so thin that the forces exerted on the cutting blades 24 at inertia of release and during the flight of the arrow allow the cutting blades 24 to cut through the tubular restraint, nor should the dimensions of the tubing be so thick that the tubular restraint 20 hinders opening of the cutting blades 24 upon impact with an animal. Good results were also obtained earlier when scotch tape was wrapped around the broadhead as the tubular restraint 20. One problem with scotch tape is that it must be peeled from the broadhead body 16 when the broadhead 10 is reused. As above, if tape were used as the tubular restraint 20, the number of wrappings can be varied, but should be selected so as not to produce a tubular restraint 20 that is either too thick or too thin.

While plastic tubing and tape have yielded good results as tubular restraints 20 it is likely that many other materials could fulfill the functions of, first, holding the cutting blades 24 in the retracted position during flight and, second, being sliced away from the broadhead 10 when the cutting blades 24 are moved the open configuration. For example, the tubular restraint could be made of cardboard, rubber tubing, a frangible member, or any other suitable material. In addition, the ideal characteristics needed for the tubular restraint can vary depending on the mechanism by which the plunger operates the cutting blades, i.e., some broadheads may require a thicker tubular restraint than others because the forces acting on the plunger are greater.

An advantage of the present invention over the prior art is that the tubular restraint 20 can be used on almost any broadhead with deployable blades 24. All that is required is that the internal diameter of the tubular restraint be sized such that deployable blades 24 are held in their retracted position and that the tubular restraint 20 be strong enough to withstand any outward pressures exerted on the deployable blades 24 when the arrow is shot yet weak enough to allow a cutting edge of the deployable blades 24 to slice therethrough when the arrow impacts against an animal. It is anticipated that the tubular restraint 20 can fit over a cylindrical body 16 as shown in FIG. 1 or it can fit directly on exposed blades (as would be the case in a broadhead similar that described in U.S. Pat. No. 4,504,063 to LeBus). If the tubular restraint 20 fit around exposed cutting blades, the material from which it is made would need to be thick enough so that the blades did not slice through the tubular restraint 20 when it is installed.

While the invention has been described in terms of its preferred embodiment, those skilled in the art will recognize that the invention can be practiced with modification within the spirit and scope of the appended claims.

Having thus described my invention, what I claim as new and desire to secure by Letters Patent is as follows:

1. A broadhead, comprising:

a body having a top, a bottom, and a middle region, said bottom of said body being connectable to an arrow shaft, said middle region of said body defining a first outer perimeter measuring a first distance around said body at said middle region;

a pair of cutting blades which are deployable from opposite sides of said body at said middle region, each of said pair of cutting blades having first and second ends wherein a first end is close to said body when said pair of cutting blades are either in a retracted position or a deployed position but said second end is close to said body only when said cutting blades are in said retracted position and is extended away from said body when said pair of cutting blades are in said deployed position, each of said cutting blades having a cutting edge located between said first and second ends that is directed away from said body when said pair of cutting blades are in said retracted position, said cutting edges of said pair of cutting blades being includable in a second outer perimeter which is the same size or larger than said first outer perimeter and which measures a second distance that includes the distance around said body at said middle region plus the distance around said cutting blades if they extend beyond said first outer perimeter that is when said cutting blades are in said retracted position;

means for moving said pair of cutting blades from said retracted position to said deployed position; and a cuttable tubular restraining device having an internal diameter approximately equal to said first outer perimeter and being located around said first outer perimeter to hold said pair of cutting blades in said retracted position, said cuttable tubular restraining device being made of a material and having dimensions which can withstand forces that occur when an arrow is shot or in flight which would otherwise cause said cutting edges of said pair of cutting blades to cut through said cuttable tubular restraining device but which allows said cutting edges of said pair of cutting blades to cut through said cuttable tubular restraining device upon impact of the broadhead with a target.

2. A broadhead as recited in claim 1 wherein said means for moving said cutting blades from said retracted position to said deployed position includes a plunger which extends beyond said top of said body and which is slidable within a bore in said body.

3. A broadhead as recited in claim 2 wherein said cutting blades are pivotally connected to said plunger.

4. A broadhead as recited in claim 1 wherein said tubular restraining device is made of a plastic material.

5. A broadhead as recited in claim 1 wherein said tubular restraining device is made of rubber material.

6. A broadhead as recited in claim 1 wherein said tubular restraining device is made of a paper material.

7. A broadhead as recited in claim 1 wherein said tubular restraining device is made of cardboard.

* * * * *